US006283142B1

(12) United States Patent
Wheeler et al.

(10) Patent No.: US 6,283,142 B1
(45) Date of Patent: Sep. 4, 2001

(54) DUAL FUEL DELIVERY MODULE SYSTEM FOR BIFURCATED AUTOMOTIVE FUEL TANKS

(75) Inventors: Tony Joe Wheeler, Anderson, SC (US); Paul Wickett, Northville; Rolf Fischerkeller, White Lake, both of MI (US)

(73) Assignee: Robert Bosch Corporation, Broadview, IL (US)

( * ) Notice: Subject to any disclaimer, the term of this patent is extended or adjusted under 35 U.S.C. 154(b) by 0 days.

(21) Appl. No.: 09/498,313

(22) Filed: Feb. 4, 2000

(51) Int. Cl.[7] ..... F02M 37/10; F02M 37/14

(52) U.S. Cl. ..... 137/265; 137/565.22; 137/565.33; 123/509; 123/514

(58) Field of Search ..... 137/265, 565.22, 137/565.3, 565.33, 574, 576; 123/509, 514

(56) References Cited

U.S. PATENT DOCUMENTS

| | | | | |
|---|---|---|---|---|
| 3,884,255 | | 5/1975 | Merkle . | |
| 4,683,864 | * | 8/1987 | Bucci | 123/514 X |
| 4,838,307 | * | 6/1989 | Sasaki et al. | 137/574 |
| 4,860,714 | | 8/1989 | Bucci . | |
| 5,020,566 | * | 6/1991 | Shoop | 137/265 |
| 5,078,169 | * | 1/1992 | Scheurenbrand et al. | 137/574 |
| 5,163,466 | | 11/1992 | Moody . | |
| 5,197,444 | | 3/1993 | Lang et al. . | |
| 5,360,034 | | 11/1994 | Der Manuelian . | |
| 5,450,832 | | 9/1995 | Graf . | |
| 5,623,910 | | 4/1997 | Riggle . | |
| 5,647,328 | | 7/1997 | Fournier et al. . | |
| 5,647,329 | | 7/1997 | Bucci et al. . | |
| 5,732,684 | * | 3/1998 | Thompson | 123/514 |
| 5,850,851 | | 12/1998 | Miura et al. . | |
| 5,875,816 | | 3/1999 | Frank et al. . | |
| 5,881,698 | | 3/1999 | Tuckey et al. . | |
| 5,896,846 | | 4/1999 | Bauer et al. . | |
| 5,983,932 | | 11/1999 | Wagner et al. . | |

FOREIGN PATENT DOCUMENTS 0 979 939 A2 2/2000 (EP) .

* cited by examiner

*Primary Examiner*—John Rivell
(74) *Attorney, Agent, or Firm*—Michael Best & Friedrich, LLP

(57) ABSTRACT

A fuel system including first and second tank portions communicating with each other such that the first and second tank portions have a substantially equal vapor pressure, first and second fuel pumps in the first and second tank portions, respectively, and a crossover fuel line for transferring fuel in either direction between the first and second tank portions, the direction of transfer depending on the relative level of fuel in the first and second tank portions. Respective first and second shuttle valves control the direction of fuel flow through the single crossover line to maintain substantially equal fuel levels in both bifurcated portions until the tank is empty. First and second jet pumps communicate with the crossover fuel line and provide the suction needed for fuel transfer.

20 Claims, 3 Drawing Sheets

DUAL FUEL DELIVERY MODULE SYSTEM FOR BIFURCATED AUTOMOTIVE FUEL TANKS

FIELD OF THE INVENTION

The invention relates to fuel delivery systems for automobiles, and more specifically to dual fuel pump delivery systems in bifurcated fuel tanks.

BACKGROUND OF THE INVENTION

The use of bifurcated fuel tanks, also commonly referred to as saddle tanks, in conjunction with fuel delivery systems having a single fuel pump is known. In such systems, a reservoir surrounds the fuel pump and is constantly filled to ensure that a steady supply of fuel is available to the pump at all times. Normally, fuel is drawn into the fuel pump from the bifurcated tank portion housing the fuel pump, but if the fuel level is low or vehicle maneuvering is such that the fuel pump inlet cannot draw fuel, the fuel pump instantly draws fuel from the reservoir. A jet pump is used to draw fuel through a crossover line from the opposing bifurcated portion of the tank and pump the fuel into the reservoir. The reservoir is usually overflowing and excess fuel fills the bifurcated tank portion housing the fuel pump. This insures that if fuel remains in either of the bifurcated tank portions, it is available to the fuel pump.

Today's high-performance and high-power automobiles require a higher rate of fuel flow to the engine than can often be provided with a single fuel pump. It has become necessary to utilize two fuel pumps, operating in parallel, to provide the necessary fuel delivery to the engine. A bifurcated tank presents an appropriate environment for using dual fuel pump delivery systems as one fuel pump can be housed in each of the two bifurcated tank portions. Since the engine demands fuel flow from both fuel pumps, it is important that both tank portions and both fuel pumps have a sufficient amount of fuel. Due to automobile maneuvering (wherein fuel sloshes over the bifurcating wall of the tank), partial tank filling and variations in fuel pump flow capacities, the fuel levels in the bifurcated portions are often unequal.

SUMMARY OF THE INVENTION

The use of bifurcated fuel tanks with two fuel pumps operating in parallel mandates a method of equalizing the fuel levels in each of the bifurcated tank portions. To equalize the fuel levels, fuel must be transferred from one portion of the bifurcated tank to the other portion.

One way to achieve such transfer would be to utilize two jet pumps each having its own dedicated crossover fuel line that transfers fuel over the bifurcating wall. This would be a system similar to that described above for use with single fuel pump delivery systems, only doubled to accommodate the dual fuel pumps. The first crossover fuel line would be connected to the first jet pump and would be dedicated to transferring fuel from the second bifurcated portion to the reservoir in the first bifurcated portion. The second crossover fuel line would be connected to the second jet pump and would be dedicated to transferring fuel from the first bifurcated portion to the reservoir in the second bifurcated portion. Ideally, both jet pumps and crossover lines, working independently of one another, would equalize the fuel level in the bifurcated portions of the tank as the tank empties.

One problem associated with using two individually-dedicated jet pump and crossover line systems to equalize the fuel level in bifurcated tanks is that the jet pumps often have different efficiencies resulting in one bifurcated portion becoming empty before the other. If one jet pump is more efficient than the other, the more efficient jet pump empties its respective bifurcated portion faster than the less efficient jet pump can supply fuel from its respective bifurcated portion. As such, the less efficient jet pump cannot equalize the fuel level between the bifurcated portions. If one bifurcated portion empties first, and the respective fuel pump lacks a sufficient fuel supply, fuel flow interruptions will occur, creating increased HC and NOX emissions and putting the engine and catalytic converter reliability at risk. In addition to potentially damaging the engine, there is a good chance that the fuel pump, which continues to run without pumping any fuel, will be damaged.

The present invention alleviates these problems by incorporating a single crossover fuel line that communicates with both jet pumps. Two shuttle valves control the direction of fuel flow through the single crossover line to maintain substantially equal fuel levels in both bifurcated portions until the tank is empty. Should one bifurcated portion empty before the other, both jet pumps draw fuel from the bifurcated portion with the remaining fuel, thereby insuring that both fuel pumps continue to provide fuel to the engine until both bifurcated portions are substantially empty. Unlike using two individually-dedicated jet pumps and crossover lines, fuel is only transferred when necessary, as opposed to constantly pumping fuel out of and into both tank portions.

Other features and advantages of the invention will become apparent to those skilled in the art upon review of the following detailed description, claims, and drawings.

Figure 1:
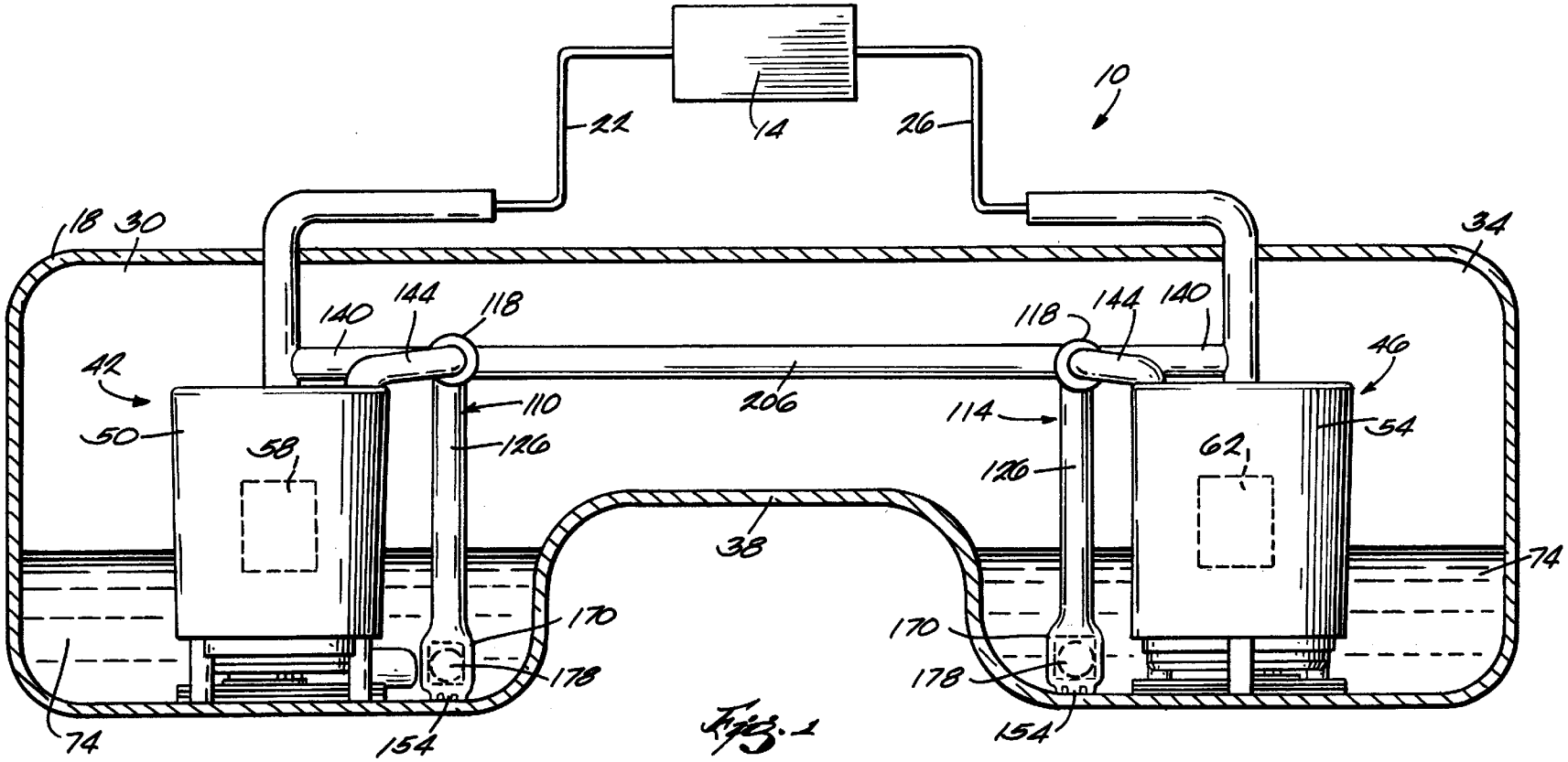
FIG. 1 is a partial section view of a dual fuel pump delivery system embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

Figure 2:
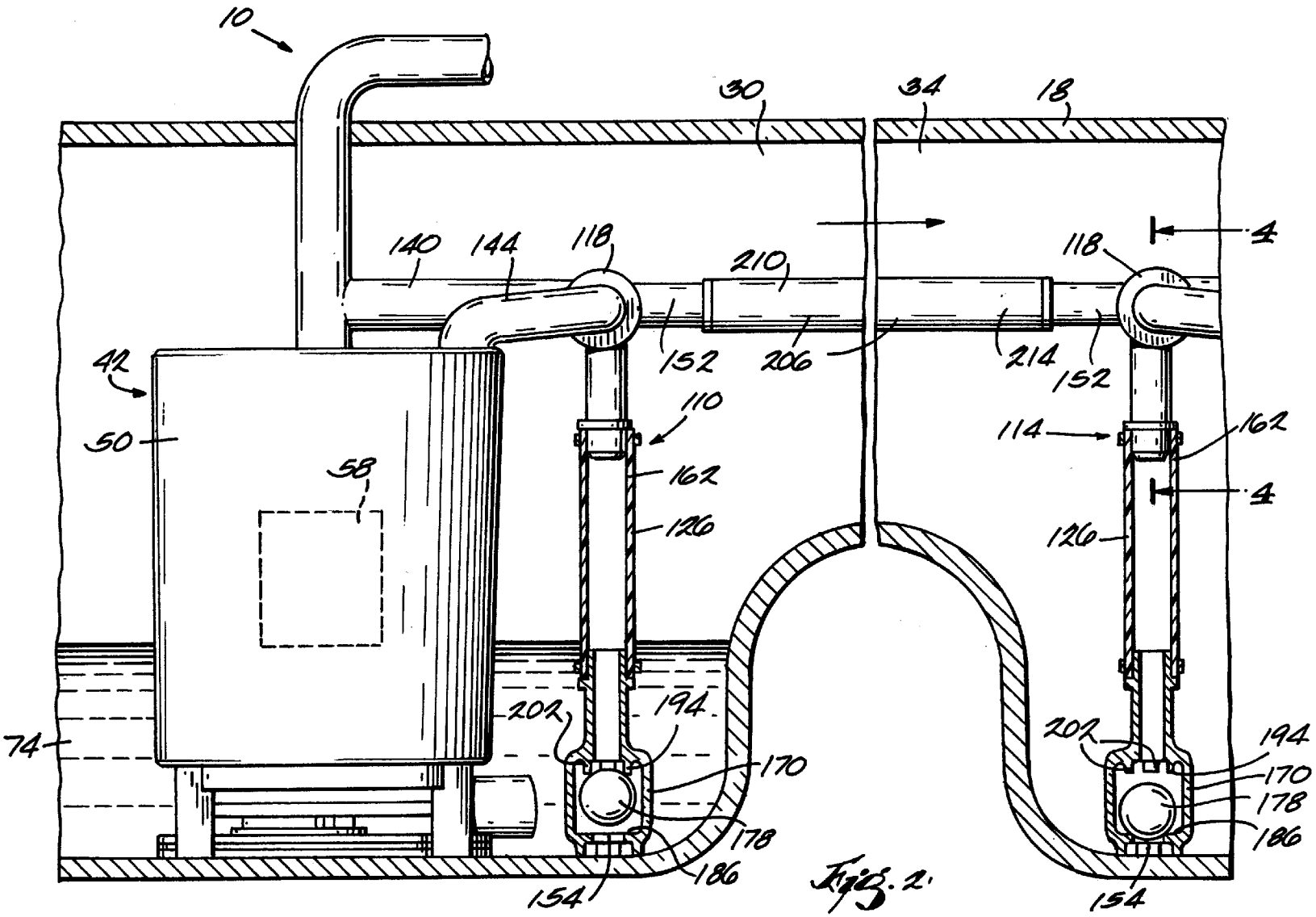
FIG. 2 is an enlarged partial section view of the system illustrating the fuel transfer operation.

FIG. 1 illustrates a fuel system 10 embodying the present invention. The fuel system 10 is for use in conjunction with an internal combustion engine 14 that requires a relatively high rate of fuel flow (i.e., a supercharged engine). A bifurcated fuel tank 18, having a first tank portion 30 and a second tank portion 34 is shown in FIGS. 1 and 2. This type of bifurcated fuel tank is commonly known as a "saddle tank" due to its saddle-like shape. A wall or hump 38 partially separates the first and second tank portions 30 and 34, but allows the tank 18 to maintain a single vapor pressure throughout. It is important to note that the tank 18 need not be bifurcated in the fashion illustrated, but could be bifurcated in any other way that would permit the tank portions 30, 34 to experience a common vapor pressure.

The first and second tank portions 30, 34 house respective first and second fuel delivery modules 42, 46 which are substantially the same. The first and second fuel delivery modules 42, 46 include respective first and second reservoirs 50, 54, that are at least partially open at the top, and first and second fuel pumps 58, 62 inside the respective reservoirs 50, 54. The fuel pumps 58, 62 supply fuel 74 to the engine 14 via a first fuel supply line 22 and a second fuel supply line 26, respectively.

The fuel pumps 58, 62 are substantially identical and can draw fuel directly from the respective bifurcated tank portions 30, 34 or from the respective reservoirs 50, 54 as is well known in the art. When there is sufficient fuel 74 in the tank portions 30, 34, the pumps 58, 62 draw fuel from the respective tank portions 30, 34. When there is an insufficient amount of fuel 74 in the tank portions 30, 34 or the fuel 74 is not available at the pump inlets (not shown) due to vehicle maneuvering, the pumps 58, 62 draw fuel from the respective reservoirs 50, 54. This insures that the fuel pumps 58, 62 always have an available supply of fuel 74 during periods of low fuel levels and high vehicle maneuvering.

Since the engine 14 requires fuel flow from both fuel pumps 58, 62, an interruption in the fuel flow from either fuel pump 58, 62 could damage the engine 14 and catalytic converter (not shown) and should be avoided. Furthermore, the fuel pumps 58, 62 may also be damaged if operated without fuel 74 for a nominal period of time. To prevent such damage, fuel 74 is constantly supplied to the reservoirs 50, 54 as will be described below. The constant supply of fuel 74 means the reservoirs 58, 62 are substantially always full and overflowing into the respective tank portions 30, 34 during normal operation.

First and second fuel transfer units 110, 114 are located in respective tank portions 30, 34 adjacent the respective fuel delivery modules 42, 46 and transfer fuel from the tank portions 30, 34 into the respective reservoirs 50, 54. The fuel transfer units 110, 114 are substantially identical and common elements have been given the same reference numerals. Only the fuel transfer unit 114 will be described in detail. Distinctions made between components and characteristics of the fuel transfer units 110 and 114 will be made explicitly.

The fuel transfer unit 114 includes ajet pump 118 and a fuel pickup tube 126. The jet pump 118 (see FIG. 4) works using the Venturi effect and includes an inlet 134 having a restricted diameter portion 138 for receiving high pressure fuel 74 and converting the pressure to velocity as is commonly understood. A supply tube 140 is connected to the inlet 134 and supplies fuel 74 to the jet pump 118 (see FIGS. 1 and 2) from a diverted portion of the high pressure engine supply coming from the fuel pump 62. Alternatively fuel may be supplied to the jet pump 118 from a regulated return line (not shown) returning fuel to the tank 18.

Figure 4:
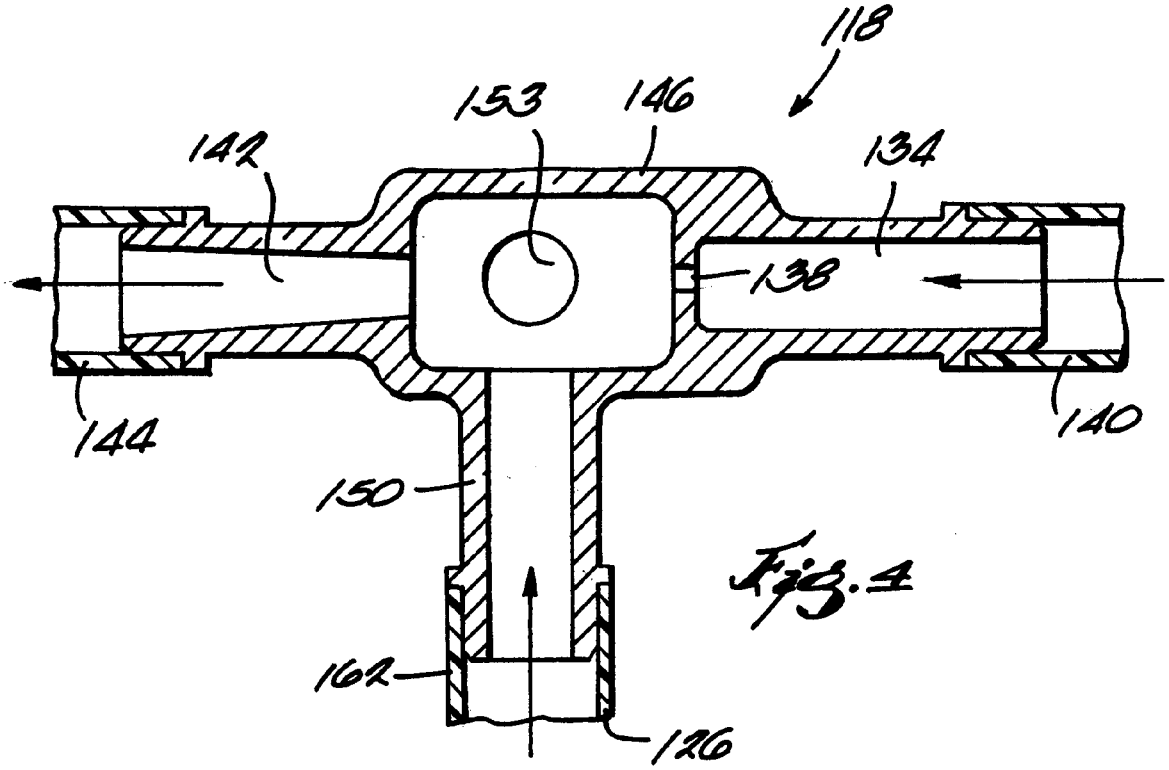
FIG. 4 is a sectional view of the jet pump taken along line 4—4 in FIG. 2.

The high velocity fuel 74 exits the jet pump 118 through an outlet 142. Outlet tube 144 is connected to the outlet 142 and communicates with the reservoir 54. Preferably, the outlet tube 144 communicates with the reservoir 54 such that fuel 74 enters the filled reservoir 54 below fuel surface level so as not to splash and cause vapor pressure build-up. As seen in FIG. 4, the jet pump 118 includes an intermediate portion 146 having a pickup tube connector portion 150 connected to and communicating with the pickup tube 126. The jet pump 118 also has a connector portion 152 (see FIG. 2) communicating with the intermediate portion 146 through a bore 153 (shown in FIG. 4).

Figure 3:
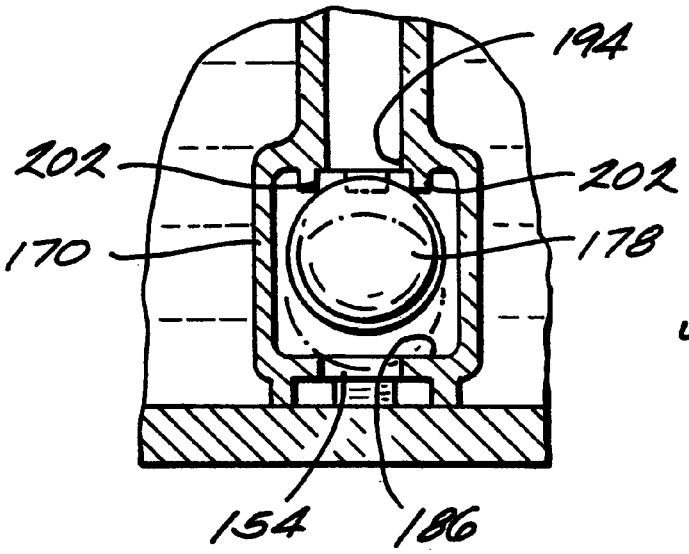
FIG. 3 is an enlarged partial section view illustrating a shuttle valve.

The fuel pickup tube 126 includes an inlet 154 adjacent the bottom of the tank portion 34, an outlet 162 connected to and communicating with the pickup tube connector portion 150, and a shuttle valve 170 between the inlet 154 and outlet 162. The shuttle valve 170 is preferably adjacent the inlet 154 and includes a blocking member 178. As best seen in FIG. 3, the shuttle valve 170 also includes a lower seat 186 and an upper seat 194. The lower seat 186 is adjacent the pickup tube inlet 154 such that when the blocking member 178 is seated on the lower seat 186 (as shown in phantom lines in FIG. 3), the inlet 154 is substantially blocked and no fuel 74 can enter or exit the pickup tube 126. When the blocking member 178 is seated on the lower seat 186, the valve 170 is closed.

When the blocking member 178 is not on the lower seat 186 or is seated on the upper seat 194 (as shown in solid lines in FIG. 3), the shuttle valve 170 is open. Upper seat tabs 202 contact the blocking member 178 but permit the flow of fuel 74 around the blocking member 178 and up the pickup tube 126. Fuel 74 enters the pickup tube 126 via the inlet 154, flows around the blocking member 178 and is drawn up the pickup tube 126 by the jet pump 118.

While the upper seat tabs 202 are shown as spaced ridges or projections, other configurations for upper seat tabs 202 could also be used. The blocking member 178 is illustrated as a spherical member but could be various other shapes, such as a flat disk, that achieves the same results. The blocking member 178 can be made of any suitable material capable of withstanding degradation by the fuel 74, such as metals or various plastics. Furthermore, the blocking member 178 should be made from material that will not absorb fuel 74, as the weight of the blocking member 178 must remain substantially constant.

The blocking member 178 is calibrated or designed such that a specific predetermined pressure head $H_b$ is required to raise the blocking member 178 from the closed position, wherein the blocking member 178 is seated on the lower seat 186, to the open position, wherein the blocking member 178 is seated on the upper seat 194. The blocking member 178 of the fuel transfer unit 110 requires a pressure head $H_{b1}$ to cause movement from the closed position to the open position while the blocking member 178 of the fuel transfer unit 114 requires a pressure head $H_{b2}$ to cause movement from the closed position to the open position. Pressure heads $H_{b1}$ and $H_{b2}$ are preferably substantially the same, but this need not be the case. The pressure heads $H_{b1}$ and $H_{b2}$ may be calibrated by altering the ratio between the weight and the surface area of the respective blocking members 178. The reason for such calibration will become evident below.

High velocity fuel 74 passing over the pickup tube connector portion 150 produces a suction or negative gauge pressure $H_s$ that draws fuel 74 up the pickup tube 126 and into the intermediate portion 146, where the fuel 74 exits the jet pump 118 through the jet pump outlet 142 to fill the reservoir 54. It is important to note that the jet pump 118 of the fuel transfer unit 110 will rarely, if ever, have the same efficiency as the jet pump 118 of the fuel transfer unit 114 due to variations in the respective restricted diameter portions 138 and variations in fuel pressure supplied to the respective inlets 134. As such, the jet pump 118 of the fuel transfer unit 110 produces a suction pressure $H_{s1}$ that will likely be different from a suction pressure $H_{s2}$ produced by the jet pump 118 of the fuel transfer unit 114. The significance of the difference between $H_{s1}$ and $H_{s2}$ will be more thoroughly discussed below.

Head pressure $H_b$ required to raise the blocking member 178 is specifically calibrated to be greater than the suction pressure $H_s$ created by the jet pump 118. This means that the suction from the jet pump 118 alone is not enough to raise the blocking member 178 from the closed position to the open position. In the absence of any other pressure tending to raise the blocking member 178 from the closed position to the open position, the blocking member 178 remains seated in the lower seat 186 and no fuel can enter the pickup tube 126.

The fuel 74 itself also creates a fuel pressure $H_f$ on the blocking member 178 that varies depending upon the level of fuel in the respective tank portions 30, 34 and the vapor pressure existing in the tank 18. When the level of fuel 74 is above the wall or hump 38 and the tank 18 is level, fuel pressure $H_f$ is equal in both tank portions 30, 34. When the level of fuel 74 (as seen in FIGS. 1 and 2) is below the hump 38, the blocking member 178 of the fuel transfer unit 110 experiences a first fuel pressure $H_{f1}$ and the blocking member 178 of the fuel transfer unit 114 experiences a second fuel pressure $H_{f2}$ that will be different from the first fuel pressure $H_{f1}$ when the respective fuel levels are different. Fuel pressure $H_f$ also tends to push fuel 74 up the pickup tube 126, thereby tending to raise the blocking member 178 from the closed position to the open position. In order to achieve fuel transfer from the tank portion 30 to the reservoir 50, the combination of the fuel pressure $H_{f1}$ and the suction pressure $H_{s1}$ must overcome the pressure head $H_{b1}$ required to raise the blocking member 178 of the fuel transfer unit 110 from the closed position to the open position. In order to achieve fuel transfer from the tank portion 34 to the reservoir 54, the combination of the fuel pressure $H_{f2}$ and the suction pressure $H_{s2}$ must overcome the pressure head $H_{b2}$ required to raise the blocking member 178 of the fuel transfer unit 114 from the closed position to the open position. Expressed mathematically, the shuttle valves 170 of the respective fuel transfer units 110 and 114 are open when:

$$H_{s1}+H_{f1}>H_{b1} \text{ and } H_{s2}+H_{f2}>H_{b2}$$

The pressure head $H_b$ required to raise the blocking member 178 should be calibrated so that the fuel pressure $H_f$ alone is not enough to open the shuttle valve 170. In other words, the density of the blocking member 178 must be high enough that the blocking member 178 will always sink to the closed position in the absence of suction pressure $H_s$ from the jet pump 118. Thus, when the fuel system 10 is not operating, the shuttle valve 170 will be in the closed position regardless of the fuel level. This allows the fuel transfer units 110, 114 to maintain their prime between periods of operation and permits faster response time for the fuel system 10 to become operational at engine start.

The total pressure during operation $H_{total}$ in the respective fuel transfer units 110, 114 can thus be represented mathematically as follows:

$$H_{total1}=H_{s1}+H_{f1}-H_{b1} \text{ and } H_{total2}=H_{s2}+H_{f2}-H_{b2}$$

Assuming there is a sufficient level of fuel 74 in both tank portions 30, 34, the fuel transfer units 110, 114 operate substantially independently from one another. The jet pump 118 of the fuel transfer unit 110 draws fuel 74 from the first tank portion 30 up the pickup tube 126 and deposits the fuel 74 in the first reservoir 50. The jet pump 118 of the fuel transfer unit 114 draws fuel 74 from the second tank portion 34 up the pickup tube 126 and deposits the fuel 74 in the second reservoir 54.

Fuel is transferred between tank portions 30, 34 by a single fuel crossover line or conduit 206 that includes opposite ends 210 and 214 communicating with the connector portions 152 (and thus with the intermediate portions 146) of the jet pumps 118 of the fuel transfer units 110 and 114, respectively. The fuel crossover line 206, like all of the other conduits in the fuel system 10, may be made from any material suitable for use in the fuel tank 18 environment, such as plastic.

Fuel crossover between the first tank portion 30 and the second tank portion 34 occurs when the fuel level in either tank portion gets low enough so the respective blocking member 178 moves from the open position to the closed position. Normally, the fuel level in one of the tank portions 30, 34 will reach this substantially empty level before the fuel level in the other tank portion 30, 34 does. This may be due to disparities in jet pump efficiency, disparities in fuel pump flow capacity, partial and incomplete filling of the tank 18, or vehicle maneuvering. In order to maintain the needed fuel supply for both fuel pumps 58, 62, fuel 74 must be transferred from the tank portion 30, 34 having sufficient fuel to the tank portion 30, 34 having insufficient fuel.

FIG. 2 illustrates one of the conditions that lead to fuel crossover. The first tank portion 30 is sufficiently filled with fuel 74 such that the blocking member 178 of the fuel transfer unit 110 is in the open position. The second tank portion 34, on the other hand, is shown with an insufficient level of fuel 74, which means that $H_{f2}$ approaches zero The blocking member 178 of the fuel transfer unit 114 is therefore in the closed position since the suction pressure $H_{s2}$ alone is smaller than the pressure head $H_{b2}$ required to raise the blocking member 178 to the open position. The mathematical expressions for the total pressures in the respective fuel transfer units 110 and 114 is expressed by:

$$H_{total1}=H_{s1}+H_{f1}-H_{b1} \text{ and } H_{total2}=H_{s2}-H_{b2}$$

At this point, the pressure $H_{totl1}$ in fuel transfer unit 110 is greater than the pressure $H_{total2}$ in the fuel transfer unit 114. This pressure differential causes the fuel 74 to be transferred through the fuel crossover line 206 from the first tank portion 30 to the second tank portion 34 (as shown by the arrow in FIG. 2). The jet pumps 118 of the fuel transfer units 110 and 114 work cumulatively to draw fuel 74 up the pickup tube 126 of the fuel transfer unit 110. Due to the lower pressure in the fuel transfer unit 114, the fuel 74 in the intermediate portion 146 of the jet pump 118 of the fuel transfer unit 110 enters the end 210 of the fuel crossover line 206 instead of taking the normal route to the first reservoir 50. The fuel 74 is transferred through the fuel crossover line 206, into the intermediate portion 146 of the jet pump 118 of the fuel transfer unit 114, and into the second reservoir 54. The fuel crossover supplies fuel to the second reservoir 54 so that the second fuel pump 62 maintains an adequate supply of fuel. When the second reservoir 54 becomes fuell, fuel 74 overflows into the second tank portion 34. The overflow continues until the fuel level in the second tank portion 34 is high enough to create a fuel pressure $H_{f2}$ adequate to raise the blocking member 178 of the fuel transfer unit 114 to the open position. When this occurs, the pressure differential disappears and fuel crossover through the fuel crossover line 206 substantially ceases.

It is important to note that the fuel crossover described above works substantially the same way when the level of fuel in the first tank portion 30 is insufficient and the level of fuel in the second tank portion 34 is sufficient (i.e., the mirror image of FIG. 2). The only difference is that fuel is transferred in the opposite direction of that shown in FIG. 2, so fuel from the second tank portion 34 is transferred to the first tank portion 30. Again, this dual-directional fuel transfer capability is provided with only one fuel crossover line 206.

Fuel crossover will typically only occur when the fuel level in one of the tank portions 30, 34 becomes low. Just how low the fuel must be before crossover occurs depends upon the calibration of the blocking members 178. The closer the pressure head required to raise the blocking member $H_b$ is to the suction pressure $H_s$, the less fuel needed to create the fuel pressure $H_f$ required to keep the blocking members 178 in the open position. Therefore, by calibrating the blocking members 178, the designer can determine how low the fuel level will be before crossover occurs. Variations in jet pump efficiency, fuel pump flow capacity and vehicle maneuvering may cause the fuel level advantage to repeatedly switch between tank portions 30, 34. When this occurs, the shuttle valves 170 will open and close accordingly to transfer fuel 74 and equalize the fuel levels in the tank portions 30, 34. Obviously, when the amount of fuel in both tank portions 30, 34 becomes insufficient, crossover will cease and the engine will eventually stall.

Various features of the invention are set forth in the following claims.

What is claimed is:

1. A fuel system comprising:

first and second tank portions communicating with each other such that the first and second tank portions have a substantially equal vapor pressure;

first and second fuel pumps in the first and second tank portions, respectively; and a crossover fuel line for transferring fuel in either direction between the first and second tank portions, the direction of transfer depending on the relative level of fuel in the first and second tank portions.

2. The fuel system of claim 1, wherein the first and second tank portions define a saddle tank.

3. A fuel system comprising:

first and second tank portions communicating with each other such that the first and second tank portions have a substantially equal vapor pressure;

first and second fuel pumps in the first and second tank portions, respectively;

a crossover fuel line for transferring fuel in either direction between the first and second tank portions, the direction of transfer depending on the relative level of fuel in the first and second tank portions;

a first jet pump in the first tank portion communicating with the crossover fuel line for pulling fuel through the crossover fuel line; and a second jet pump in the second tank portion communicating with the crossover fuel line for pulling fuel through the crossover fuel line.

4. The fuel system of claim 3, further comprising:

a first fuel reservoir in the first tank portion from which the first fuel pump draws fuel; and a second fuel reservoir in the second tank portion from which the second fuel pump draws fuel.

5. The fuel system of claim 4, wherein the first and second jet pumps include respective first and second outlets communicating with the first and second reservoirs, respectively.

6. The fuel system of claim 5, wherein the crossover fuel line transfers fuel from the first tank portion to the second reservoir or from the second tank portion to the first reservoir depending on the relative level of fuel in the first and second tank portions.

7. The fuel system of claim 3, further comprising:

a first fuel pickup tube in the first tank portion, the first fuel pickup tube having a first inlet, a first outlet communicating with the first jet pump and a first valve between the first inlet and the first outlet for opening when the level of fuel in the first tank is sufficient and for closing when the level of fuel in the first tank is insufficient; and a second fuel pickup tube in the second tank portion, the second fuel pickup tube having a second inlet, a second outlet communicating with the second jet pump and a second valve between the second inlet and the second outlet for opening when the level of fuel in the second tank is sufficient and for closing when the level of fuel in the second tank is insufficient.

8. The fuel system of claim 7, wherein the first and second valves include respective first and second blocking members and the first and second valves are in an open position, allowing fuel to enter the respective inlets, when the respective blocking members are in a raised position in the presence of fuel, and the first and second valves are in a closed position, preventing air and air vapor from entering the respective inlets, when the respective blocking members are in a lowered position in the absence of fuel.

9. The fuel system of claim 8, wherein the first and second valves are also in the closed position when the fuel system is not in operation.

10. The fuel delivery system of claim 8, wherein the crossover fuel line transfers fuel between the first and second tank portions when one of either the first or second valves is in the closed position.

11. The fuel delivery system of claim 10, wherein the crossover fuel line transfers fuel from the first tank portion to the second tank portion when the second valve is in the closed position.

12. The fuel delivery system of claim 10, wherein the crossover fuel line transfers fuel from the second tank portion to the first tank portion when the first valve is in the closed position.

13. A fuel system having a first fuel transfer unit with a total pressure $H_{total1}$, and a second fuel transfer unit with a total pressure $H_{total2}$, the fuel system comprising:

first and second tank portions communicating with each other such that the first and second tank portions have a substantially equal vapor pressure and include first and second fuel levels creating pressures $H_{f1}$ and $H_{f2}$, respectively;

first and second fuel pumps in the first and second tank portions, respectively;

a crossover fuel line for transferring fuel in either direction between the first and second tank portions, the direction of transfer depending on the relative level of fuel in the first and second tank portions;

a first jet pump in the first tank portion communicating with the crossover fuel line and creating a pressure $H_{s1}$;

a second jet pump in the second tank portion communicating with the crossover fuel line and creating a pressure $H_{s2}$;

a first fuel pickup tube in the first tank portion, the first fuel pickup tube having a first inlet, a first outlet communicating with the first jet pump and a first valve between the first inlet and the first outlet for opening when the level of fuel in the first tank is sufficient and for closing when the level of fuel in the first tank is insufficient, the first valve having a first blocking member calibrated such that a pressure of $H_{b1}$ is required to lift the blocking member to an open position; and a second fuel pickup tube in the second tank portion, the second fuel pickup tube having a second inlet, a second outlet communicating with the second jet pump and a second valve between the second inlet and the second outlet for opening when the level of fuel in the second tank is sufficient and for closing when the level of fuel in the second tank is insufficient, the second valve having a second blocking member calibrated such that a pressure of $H_{b2}$ is required to lift the blocking member to an open position;

wherein the total pressure for the first fuel transfer unit is $H_{total1}=H_{s1}+H_{f1}-H_{b1}$, and the total pressure for the second fuel transfer unit is $H_{total2}=H_{s2}+H_{f2}-H_{b2}$.

14. The fuel system of claim 13, wherein fuel is transferred through the crossover line from the first tank portion to the second tank portion when $H_{total1}>H_{total2}$.

15. The fuel system of claim 13, wherein fuel is transferred through the crossover line from the second tank portion to the first tank portion when $H_{total2}>H_{total1}$.

16. The fuel system of claim 13, wherein the first and second valves are in the open position, allowing fuel to enter the respective inlets, when $H_{s1}+H_{f1}>H_{b1}$ and $H_{s2}+H_{f2}>H_{b2}$, and the first and second valves are in a closed position, preventing air and air vapor from entering the respective inlets, when $H_{s1}+H_{f1}<H_{b1}$ and $H_{s2}+H_{f2}<H_{b2}$.

17. The fuel system of claim 13, wherein $H_{s1}<H_{b1}$ and $H_{s2}<H_{b2}$, such that the first and second valves are in the closed position when the fuel level in the respective tank portions is insufficient.

18. The fuel system of claim 13, wherein the first and second blocking members have a weight/area value and $H_{b1}$ and $H_{b2}$ are calibrated by changing the weight/area value.

19. The fuel system of claim 13, wherein $H_{s1}=0$ and $H_{s2}=0$ when the fuel system is not in operation, and $H_{f1}<H_{b1}$ and $H_{f2}<H_{b2}$ such that the first and second valves are in the closed position when the fuel system is not in operation.

20. A fuel system comprising:

first and second tank portions communicating with each other such that the first and second tank portions have a substantially equal vapor pressure;

first and second fuel pumps in the first and second tank portions, respectively;

a first fuel reservoir in the first tank portion from which the first fuel pump draws fuel;

a second fuel reservoir in the second tank portion from which the second fuel pump draws fuel;

a crossover fuel line for transferring fuel in either direction between the first and second tank portions, the direction of transfer depending on the relative level of fuel in the first and second tank portions;

a first jet pump in the first tank portion communicating with the crossover fuel line for pulling fuel through the crossover fuel line, the first jet pump having a first outlet communicating with the first reservoir;

a second jet pump in the second tank portion communicating with the crossover fuel line for pulling fuel through the crossover fuel line, the second jet pump having a second outlet communicating with the second reservoir;

a first fuel pickup tube in the first tank portion, the first fuel pickup tube having a first inlet, a first outlet communicating with the first jet pump and a first valve between the first inlet and the first outlet for opening when the level of fuel in the first tank is sufficient and for closing when the level of fuel in the first tank is insufficient, the first valve having a first blocking member such that the first valve is in an open position, allowing fuel to enter the first inlet, when the first blocking member is in a raised position in the presence of fuel, and the first valve is in a closed position, preventing air and air vapor from entering the first inlet, when the first blocking member is in a lowered position in the absence of fuel; and a second fuel pickup tube in the second tank portion, the second fuel pickup tube having a second inlet, a second outlet communicating with the second jet pump and a second valve between the second inlet and the second outlet for opening when the level of fuel in the second tank is sufficient and for closing when the level of fuel in the second tank is insufficient, the second valve having a second blocking member such that the second valve is in an open position, allowing fuel to enter the second inlet, when the second blocking member is in a raised position in the presence of fuel, and the second valve is in a closed position, preventing air and air vapor from entering the second inlet, when the second blocking member is in a lowered position in the absence of fuel.

* * * * *